US008576258B2

(12) United States Patent
Chen et al.

(10) Patent No.: US 8,576,258 B2
(45) Date of Patent: Nov. 5, 2013

(54) BRIGHTNESS COMPENSATION APPARATUS AND APPLICATION METHOD THEREOF

(75) Inventors: Tzong-Kwei Chen, Hsinchu County (TW); Chun-Lin Shen, Hsinchu (TW); Yi-Chen Liu, Taichung (TW); Chen-Ting Kuan, Hsinchu County (TW)

(73) Assignee: Holtek Semiconductor Inc., Hsinchu (TW)

( * ) Notice: Subject to any disclaimer, the term of this patent is extended or adjusted under 35 U.S.C. 154(b) by 993 days.

(21) Appl. No.: 12/639,835

(22) Filed: Dec. 16, 2009

(65) Prior Publication Data

US 2011/0074834 A1 Mar. 31, 2011

(30) Foreign Application Priority Data

Sep. 25, 2009 (TW) ..... 98132445 A

(51) Int. Cl.
*G09G 5/10* (2006.01)

(52) U.S. Cl.
USPC ..... 345/690; 345/77; 345/75.2; 345/74.1; 345/543; 345/544

(58) Field of Classification Search
None
See application file for complete search history.

(56) References Cited

U.S. PATENT DOCUMENTS

2007/0040841 A1* 2/2007 Kim ..... 345/531
2008/0088614 A1* 4/2008 Ozaki ..... 345/205
2009/0248961 A1* 10/2009 Chu et al. ..... 711/103

* cited by examiner

*Primary Examiner* — Joseph Haley
*Assistant Examiner* — Ifedayo Iluyomade
(74) *Attorney, Agent, or Firm* — Morris Manning & Martin LLP; Tim Tingkang Xia, Esq.

(57) ABSTRACT

For improving the brightness decay of a display due to its aging, a non-volatile memory such as Flash can be used to store a brightness accumulation value of each point of the display, and each point can be compensated for its brightness accordingly. However, the non-volatile memory suffers from incorrect write-in data or temporary power disconnection, and thus the error will exist all the time to make the display non-even. Hence, the present invention uses a multiple data backups and CRC error detection, plus new/old data comparison to protect data the non-volatile memory from incorrect brightness compensation value so as to uniform the brightness of the display.

21 Claims, 6 Drawing Sheets

BRIGHTNESS COMPENSATION APPARATUS AND APPLICATION METHOD THEREOF

BACKGROUND OF THE INVENTION

1. Field of the Invention

The present invention relates to a compensation apparatus and an application thereof, more particularly to, a compensation apparatus for a display brightness and an application thereof.

2. Description of the Prior Arts

For conventional display devices, such as FED, after being used for a while, the display will be getting darken in view of their brightness due to aging, and, since each pixel of the devices corresponds to a different period of brightness for difference colors, the aging level will differ. Hence, in order to maintain the brightness and the color even, the brightness of each pixel needs to be compensated individually.

Refer to FIG. 1, which provides a conventional display system 10. In the system 10, the record for brightness accumulation, namely, the outputs for accumulating unit 104 will be stored into a volatile memory 101 (such as DRAM) of the display system 10, and being forwarded sequentially to a driver IC 102. However, once if the system shuts down, the record will be missing, thus the outputted data of the accumulating unit 104 needs to be periodically stored in a non-volatile memory 103 such as flash so as to ensure the non-volatile characteristics for the data back to the volatile memory after the system re-boots. During the writing-in procedure for the non-volatile memory 103, since it takes a longer time for the procedure, if the system shuts down at the meanwhile or exterior interference occurs, there will be mistakes or incomplete data transmission happening to the non-volatile memory 103, and the aforesaid mistake will be again accumulated to the original brightness data so as to generate a permanent mistake, and it results in uniformity of the brightness and colors for each pixel of the display.

Accordingly, in view of the above drawbacks, it is an imperative that an apparatus and method are designed so as to solve the uniformity drawbacks as the foregoing.

SUMMARY OF THE INVENTION

In view of the disadvantages of prior art, the primary object of the present invention is to make an even brightness on a display and meanwhile improving non-uniformity for the brightness or a color at the time of compensating brightness for each pixel of the display.

The secondary object of the present invention is to, at meanwhile compensating the brightness of each pixel on a display, ensure the brightness compensation being written into a non-volatile memory in the display to be correct, and if not correct, utilize the old brightness compensation value of the display.

According to one aspect of the present invention, one skilled in the art can provide a method for enacting a color/brightness accumulation in unanimity in a writing-in or reading-out process, comprising steps of:

Hence, the present invention relates to an even brightness compensation apparatus, for cooperating with a driver IC to drive a display, comprising: a volatile memory, for storing a color/brightness accumulation value of each pixel on the display; a non-volatile memory, for preventing a missing for the color/brightness accumulation value; a calculating unit, for accumulating the color/brightness accumulation value for the each pixel; and a detector means, coupled to the calculating unit and the non-volatile memory, for checking the color/brightness accumulation value outputted from the calculating unit with the color/brightness accumulation value stored in the non-volatile memory, wherein if the checking process appears to be correct, the detector means further allows the color/brightness accumulation value outputted from the calculating unit and the color/brightness accumulation value stored in the non-volatile memory are respectively written in the non-volatile memory and the volatile memory so as to uniform a brightness of the display.

The present invention further relates to a method for providing a brightness compensation apparatus having a non-volatile memory, said brightness compensation apparatus cooperates with an driver IC to drive a display;

dividing the non-volatile memory in the brightness compensation apparatus into at least a first area and a plurality of second areas 1~n, where n is an integer greater than zero and the first area is for storing the color/brightness accumulation or high-bit data of the color/brightness accumulation, and the second area 1~n are for storing low-bit data of the color/brightness accumulation;

writing the color/brightness accumulation or the high-bit data of the color/brightness accumulation in the first area;

writing the low-bit data of the color/brightness accumulation in the second areas;

judging if the display functions properly, if yes, go to s502 or s503; if no, awaiting the display re-boots;

after the display re-boots, obtaining the low-bit data of the color/brightness accumulation from a last write-in area such as a second area j where j is an integer between 1~n, and meanwhile obtaining a complete data of the color/brightness accumulation or the high-bit data of the color/brightness accumulation; s506: judging if there exists errors in the low-bit data; and if any error, obtaining the low-bit data of the color/brightness accumulation from the second area j−1.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become readily understood from the detailed description given herein below and the accompanying drawings which are given by way of illustration only, and thus are not limitative of the present invention and wherein.

DESCRIPTION OF THE EXEMPLARY EMBODIMENTS

The following descriptions are of exemplary embodiments only, and are not intended to limit the scope, applicability, or configuration of the invention in any way. Rather, the following description provides a convenient illustration for implementing exemplary embodiments of the invention. Various changes to the described embodiments may be made in the function and arrangement of the elements described. For your esteemed members of reviewing committee to further understand and recognize the fulfilled functions and structural characteristics of the invention, several exemplary embodiments cooperating with detailed description are presented as the follows.

In one of the preferred embodiments according to the present invention, the aforementioned non-volatile memory 103 such as flash is divided into a plurality of areas (zones), each sector in the area is inserted by data error detecting code such as CRC words. During the data reading-out procedure, if the data error detecting code acquired from calculation differs from the originally stored code, then it represents that the data in this area is wrong, and correspondingly, a corresponding back-up data can be read so as to replace the mistake area data.

Figure 1:
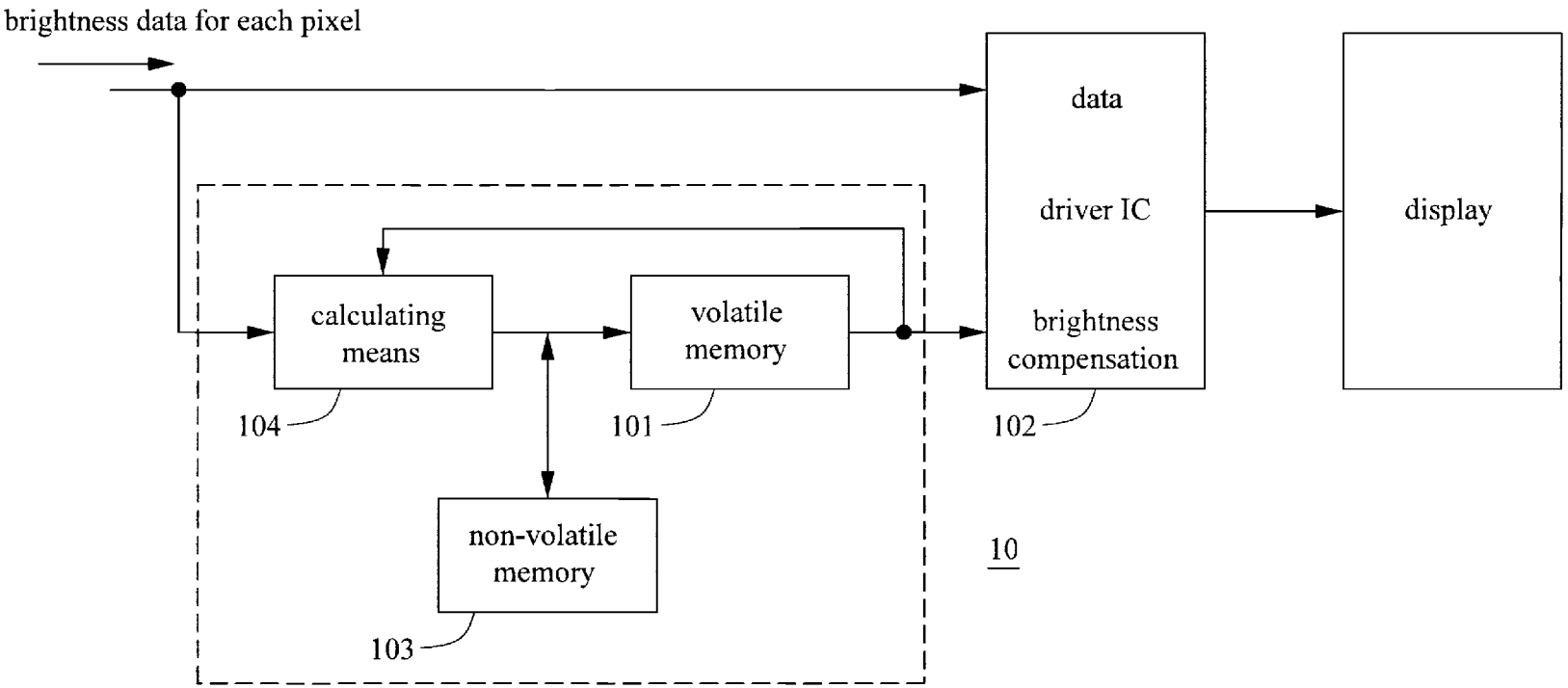
FIG.1 (Prior Art)
FIG. 1 relates to a brightness compensation apparatus according to the prior art.
Figure 2:
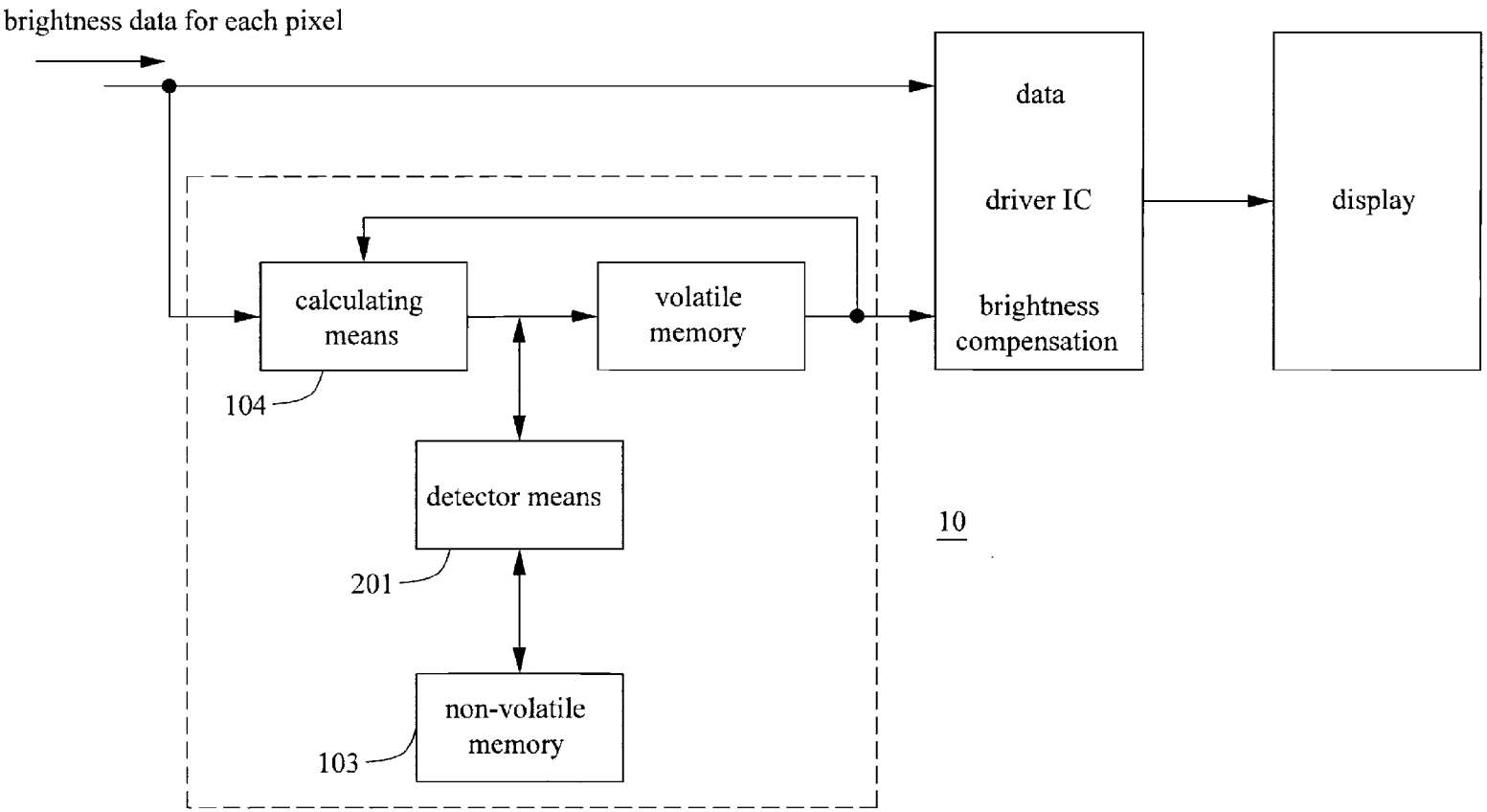
FIG. 2 relates to a brightness compensation apparatus according to the present invention.

As illustrated in FIG. 2, there is further inserted by a detector means 201 between the output of the calculating unit 104 and the non-volatile memory 103. The detector means 201 can be used for a writing-in/reading-out procedure for a data detecting code, and meanwhile for judging if the new data being written-in or read-out the non-volatile memory 103 based upon the old data already been written-in or read-out the non-volatile memory 103. Furthermore, the detector means 201 can be used for detecting the outputted color brightness accumulation value from the calculating unit 104 and comparing the same with the stored color brightness accumulation value stored in the non-volatile memory 103. If correct, allowing the outputted color brightness accumulation from the calculating means 104 and the stored color brightness value stored in the non-volatile memory 103 being respectively written in the non-volatile memory and the volatile memory so as to ensure the uniformity of the brightness for the display 10.

Figure 2A:
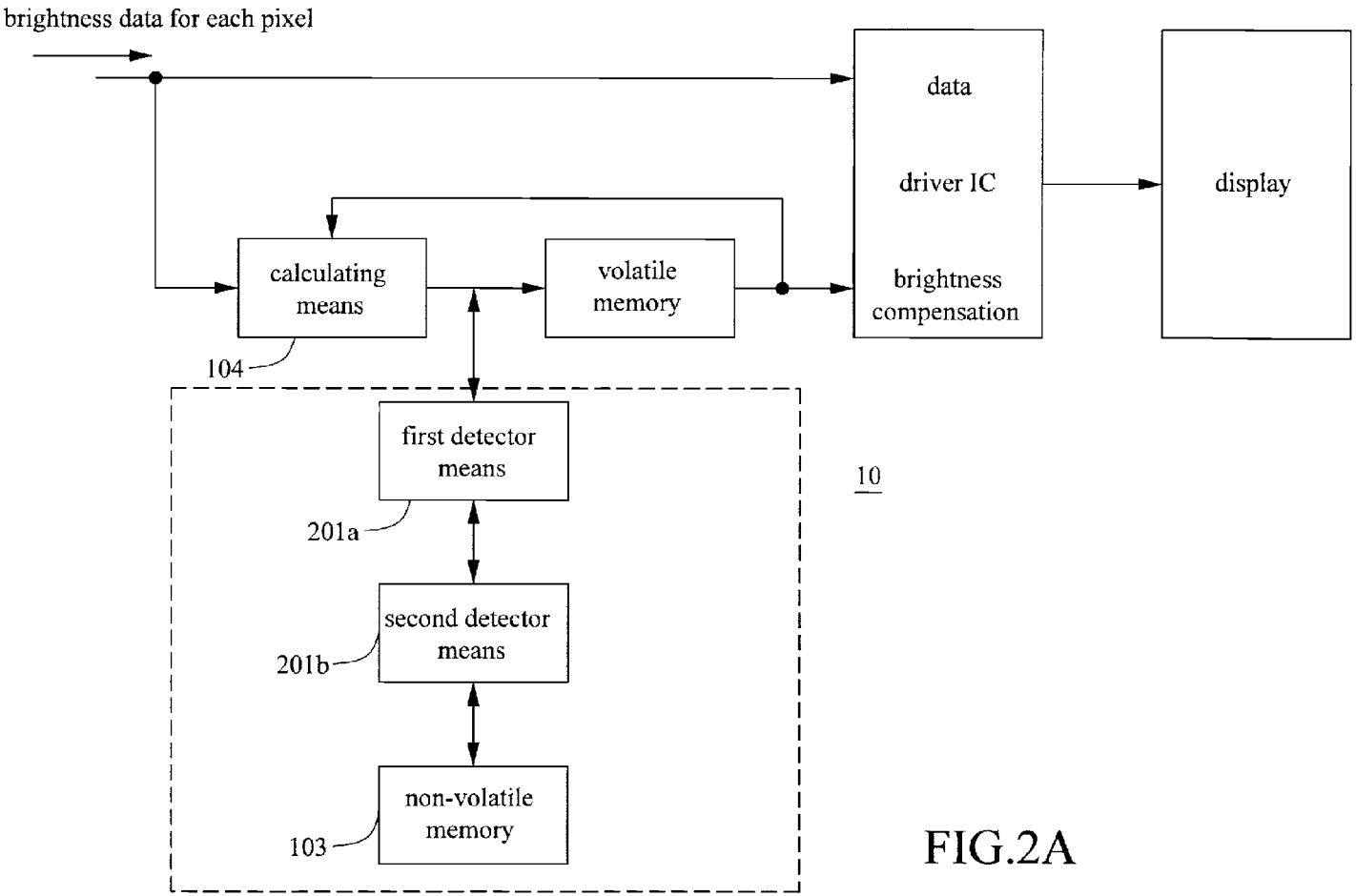
FIG. 2A relates to another brightness compensation apparatus according to the present invention.

The detector means 201 further has a first detector means 201*a* and a second detector means 201*b*, being respectively used for the writing-in or reading-out procedures for the data detecting code, and judging if the read-out/write-in data according to the old data being read out or written in the non-volatile memory 103. At this time, the output for the calculating unit 104 is coupled to the non-volatile memory 103 via the first detector means 201*a* and a second detector means 201*b*, as illustrated in FIG. 2A.

Preferably, the data detecting code can be a CRC code.

Preferably, the judging rule for the detector means 201 can be as follows: judging if $Y-X<K$; where Y is a new color brightness accumulation value for being written into the non-volatile memory, X is an original color brightness accumulation value in the non-volatile memory; and K is a maximum difference between two contiguous color brightness accumulation values in a specific time frame, or such as if $Y<X$.

Hence, if a new color brightness accumulation value is found mistake then it should not be written in the non-volatile memory 103, and if the original data (color brightness accumulation value) read out from the non-volatile memory 103 is found mistake, then a backup copy corresponding to the original color brightness accumulation data is used.

However, if the backup data is still incorrect, what can we do? To avoid the possible wrong backup data, plural backups will be safer than single backup, however, the tradeoff is the non-volatile memory 103 should be much larger so as to store the multiple backup copies data.

Figure 3:
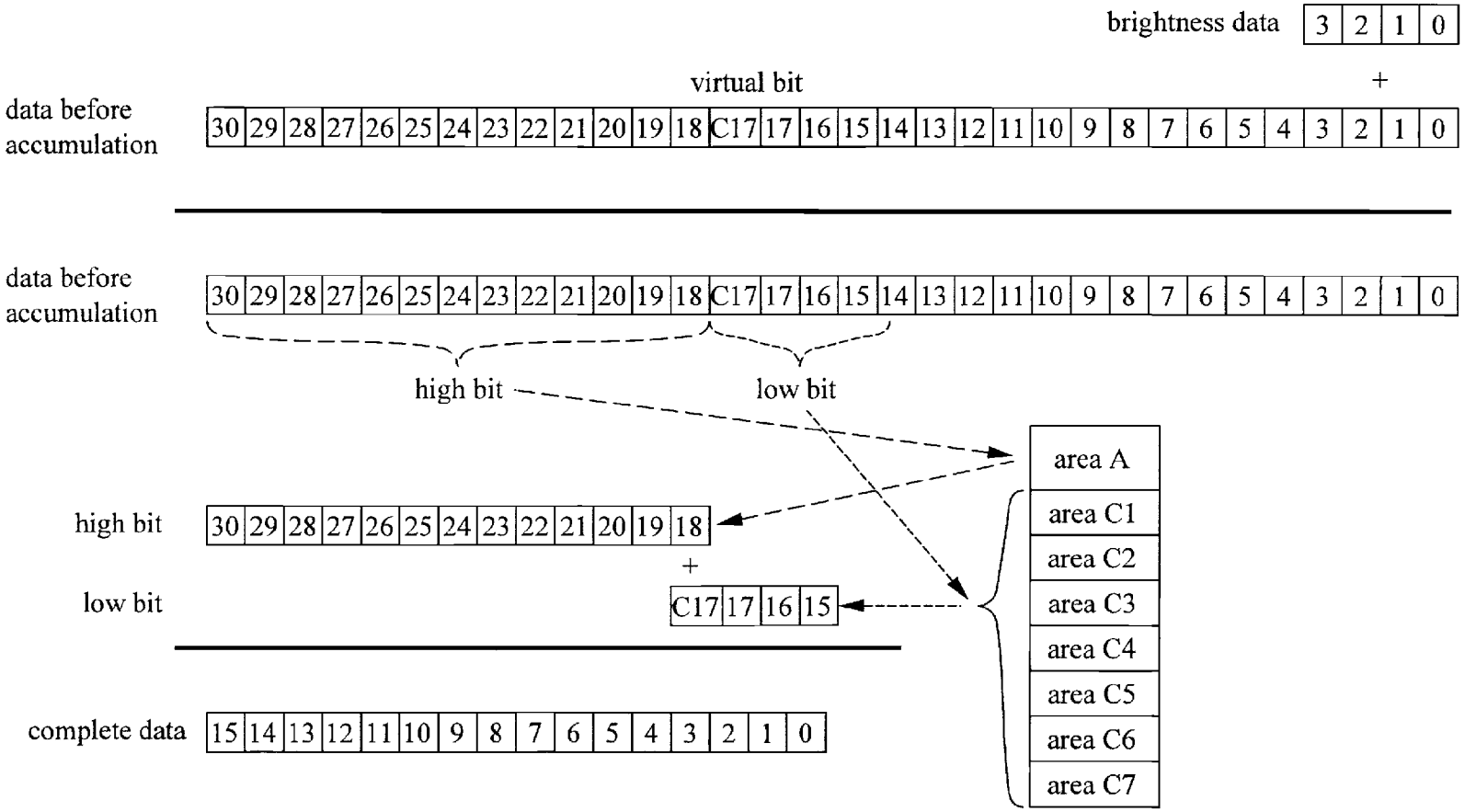
FIG. 3 relates to a diagram for non-volatile memory division according to the present invention.

For saving the space for the non-volatile memory 103, in another one of the preferred embodiments according to the present invention, FIG. 3 further illustrates the area (zone) dividing for the non-volatile memory 103 before or after the accumulation and the relationship between the high-low-bit and complete data.

Area A stores the complete data or the high-bit data for the brightness compensation, however, Area $C_1$~i stores only low-bit data (where "i" is an integer, and is set to be 7 in the present embodiment). As FIG. 3 illustrates, there are totally 8 areas to respectively store an updated data. By means of this, not only the write-in usage for the non-volatile memory can be increased but also serve as a multiple backup function. For example, if the data digested from $C_7$ is incorrect, (Such as CRC error), then the data already stored in $C_6$ can serve the recovery purpose. Even though, the adjacent data such as the ones in both $C_6$ and $C_7$ are not perfectly identical, but relatively closer to each other, thus, no apparent differences or errors will show up on the luminance or color for the display. In the similar manner, if again, the data stored in $C_6$ are still incorrect, then the data stored in $C_5$ can be digested for recovery purpose and so on so forth.

Preferably, for the non-volatile memory 103/flash memory, capacity for the area A is larger than the average capacity for Area $C_1$~i.

Figure 4:
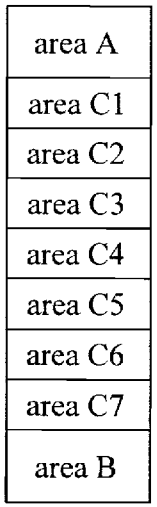
FIG. 4 relates to another diagram for non-volatile memory division according to the present invention.

However, in such a memory space allocation, there is still an issue to be addressed. Since only data stored in low-bit area, after being merged with the high-bit area data, can be treated as a real data, hence, once if there is some mistake existing in the area A, then the data cannot be recovered truly. The solution to cure the insufficiency is using another area B to back up the data stored in the area A such as illustrated by FIG. 4.

For each time of writing data in a certain area, a counter value for recording the writing-in value will also included in the data writing process thus while re-boot the machine, location for where the most updated data locates can be judged. Therefore, the process after re-booting can be described as follows:

(1) judging the last write-in area, assuming it is the area $C_i$;

(2) simultaneously digesting the data both stored in the area $C_i$ and the area A, if data in both areas are correct, then combining the low-bit data and the high-bit data so as to obtain a complete data; and (3) assuming the data digested from $C_i$ is incorrect, then digesting the data from $C_{i-1}$, so on so forth; and if the data in the area A is incorrect either, then digesting data stored in the area B. Finally, again combining the low-bit data and the high-bit data so as to obtain a complete data.

Figure 5:
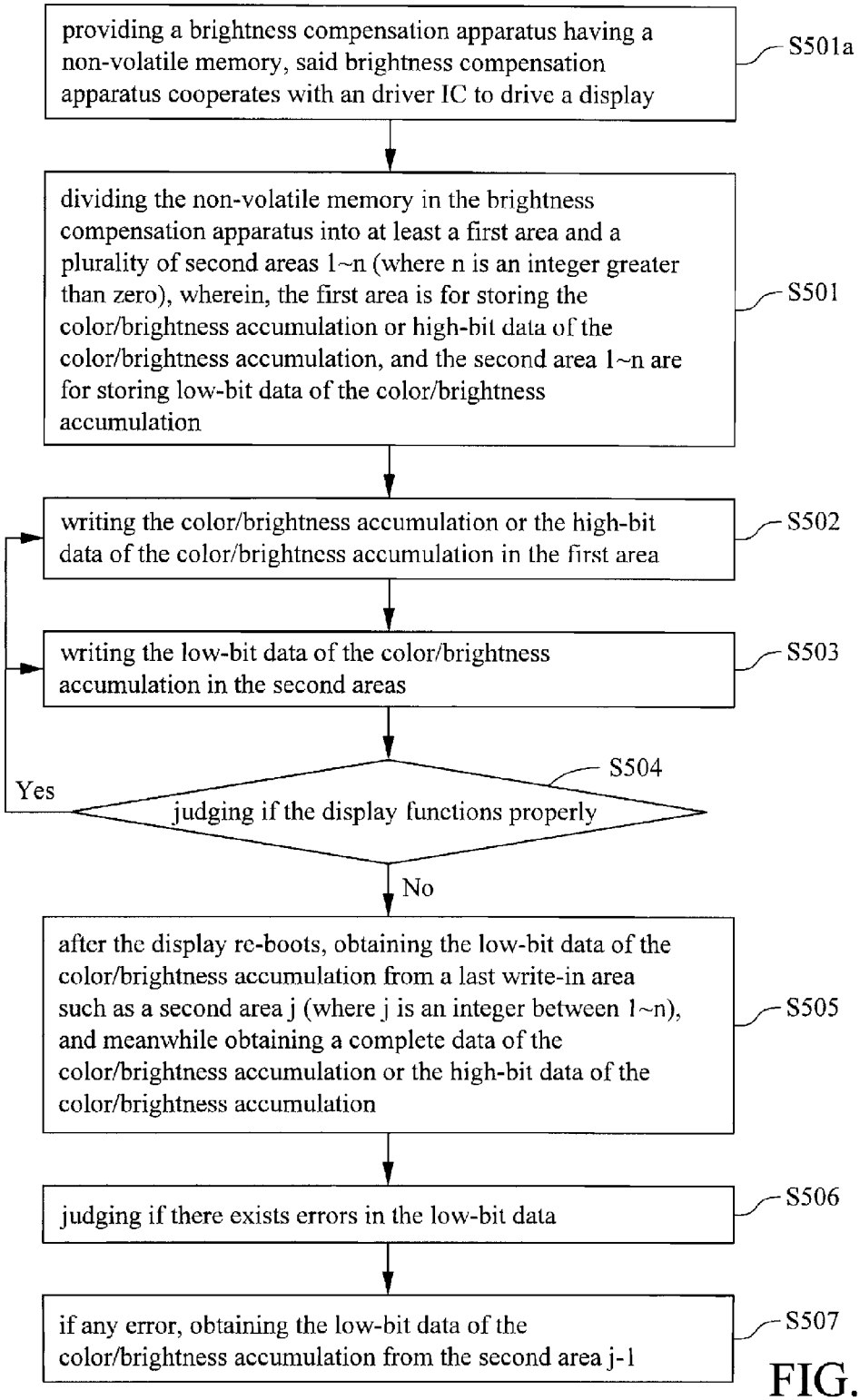
FIG. 5 relates to a flow chart of a preferred embodiment according to the present invention.

FIG. 5 further illustrates another preferred embodiment according to the present invention, which relates to a method for enacting a color/brightness accumulation in unanimity in a writing-in or reading-out process, comprising steps of: s501*a*: providing a brightness compensation apparatus having a non-volatile memory, said brightness compensation apparatus cooperates with an driver IC to drive a display; s501: dividing the non-volatile memory in the brightness compensation apparatus into at least a first area and a plurality of second areas 1~n (where n is an integer greater than zero), wherein, the first area is for storing the color/brightness accumulation or high-bit data of the color/brightness accumulation, and the second area 1~n are for storing low-bit data of the color/brightness accumulation; s502: writing the color/brightness accumulation or the high-bit data of the color/brightness accumulation in the first area; s503: writing the low-bit data of the color/brightness accumulation in the second areas; s504: judging if the display functions properly, if yes, go to s502 or s503; if no, awaiting the display re-boots; s505: after the display re-boots, obtaining the low-bit data of the color/brightness accumulation from a last write-in area such as a second area j (where j is an integer between 1~n), and meanwhile obtaining a complete data of the color/brightness accumulation or the high-bit data of the color/brightness accumulation; s506: judging if there exists errors in the low-bit data; and s507: if any error, obtaining the low-bit data of the color/brightness accumulation from the second area j−1.

Preferably, in s501, further dividing the non-volatile memory into an extra third area, where the extra third area serves the purpose for a backup for the first area;

Preferably, the method illustrated by FIG. 5 further comprises: s508: judging if there exists errors in the complete data of the color/brightness accumulation or the high-bit data stored in the first area; and s509: if there does, obtaining the color/brightness accumulation or the high-bit data of the color/brightness accumulation from the third area.

Preferably, the aforesaid areas have a plurality of sectors.

Preferably, each of the aforesaid sectors has an error detecting code such as CRC code.

Preferably, there is further included a carry virtual bit in the aforesaid second areas.

Preferably, the non-volatile memory is a flash memory.

The invention being thus aforesaid, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An brightness compensation apparatus in uniformity, for cooperating with a driver IC to drive a display, comprising:

a volatile memory, for storing a color/brightness accumulation value of each pixel on the display;

a non-volatile memory, for preventing a missing for the color/brightness accumulation value;

a calculating unit, for accumulating the color/brightness accumulation value for the each pixel; and a detector means, coupled to the calculating unit and the non-volatile memory, for checking the color/brightness accumulation value outputted from the calculating unit with the color/brightness accumulation value stored in the non-volatile memory, wherein if the checking process appears to be correct, the detector means further allows the color/brightness accumulation value outputted from the calculating unit and the color/brightness accumulation value stored in the non-volatile memory are respectively written in the non-volatile memory and the volatile memory so as to uniform a brightness of the display, wherein the non-volatile memory is divided into a first area and a plurality of second areas, and a capacity of the first area is greater than an average capacity of the plurality of the second areas, and wherein the first area stores a data detecting code for checking if data obtained from the first area are correct; and wherein the detector means follows an equation of $Y-X<K$, and wherein Y is a new color brightness accumulation value for being written into the non-volatile memory, X is an original color brightness accumulation value in the non-volatile memory, and K is a maximum difference between two contiguous color brightness accumulation values in a specific time frame.

2. The apparatus as recited in claim 1, wherein the volatile memory is a dynamic RAM.

3. The apparatus as recited in claim 1, wherein the volatile memory is a static RAM.

4. The apparatus as recited in claim 1, wherein the non-volatile memory is a flash memory.

5. The apparatus as recited in claim 1, wherein the first area is used for further storing a complete data of the color/brightness accumulation or high-bit data of the color/brightness accumulation.

6. The apparatus as recited in claim 1, wherein the second area is used for storing low-bit data of the color/brightness accumulation.

7. The apparatus as recited in claim 1, wherein the calculating unit is accumulating the color/brightness accumulation value for the each pixel in two-section format such as high-bit data and low-bit data.

8. The apparatus as recited in claim 6, wherein each of the second areas further stores a data detecting code for checking if data obtained from the second areas are correct.

9. The apparatus as recited in claim 1, wherein the non-volatile memory is further divided into an extra third area identical to the first area in their sizes to serve as a backup copy for the first area.

10. The apparatus as recited in claim 1, wherein the plurality of adjacent second areas can be backup copies for each other.

11. The apparatus as recited in claim 1, wherein the data detecting code in the first area is a CRC code.

12. The apparatus as recited in claim 8, wherein the data detecting code in the second areas is a CRC code.

13. An brightness compensation apparatus in uniformity, for cooperating with a driver IC to drive a display, comprising:

a volatile memory, for storing a color/brightness accumulation value of each pixel on the display;

a non-volatile memory, for preventing a missing for the color/brightness accumulation value;

a calculating unit, for accumulating the color/brightness accumulation value for the each pixel; and a detector means, coupled to the calculating unit and the non-volatile memory, for checking the color/brightness accumulation value outputted from the calculating unit with the color/brightness accumulation value stored in the non-volatile memory, wherein if the checking process appears to be correct, the detector means further allows the color/brightness accumulation value outputted from the calculating unit and the color/brightness accumulation value stored in the non-volatile memory are respectively written in the non-volatile memory and the volatile memory so as to uniform a brightness of the display, wherein the non-volatile memory is divided into a first area and a plurality of second areas, and a capacity of the first area is greater than an average capacity of the plurality of the second areas, and wherein the first area stores a data detecting code for checking if data obtained from the first area are correct; and wherein the detector means follows an equation of $Y<X$; and wherein Y is a new color brightness accumulation value for being written into the non-volatile memory, X is an original color brightness accumulation value in the non-volatile memory.

14. A method for enacting a color/brightness accumulation in unanimity in a writing-in or reading-out process, comprising steps of:

(a) providing a brightness compensation apparatus having a non-volatile memory, said brightness compensation apparatus cooperates with an driver IC to drive a display;

(b) dividing the non-volatile memory in the brightness compensation apparatus into at least a first area and a plurality of second areas 1~n, where n is an integer greater than zero and the first area is for storing the color/brightness accumulation or high-bit data of the color/brightness accumulation, and the second area 1~n are for storing low-bit data of the color/brightness accumulation;

(c) writing the color/brightness accumulation or the high-bit data of the color/brightness accumulation in the first area;

(d) writing the low-bit data of the color/brightness accumulation in the second areas;

(e) judging if the display functions properly, if yes, go to s502 or s503; if no, awaiting the display re-boots;

(f) after the display re-boots, obtaining the low-bit data of the color/brightness accumulation from a last write-in area such as a second area j where j is an integer between 1~n, and meanwhile obtaining a complete data of the color/brightness accumulation or the high-bit data of the color/brightness accumulation; s506:

judging if there exists errors in the low-bit data; and (g) if any error, obtaining the low-bit data of the color/brightness accumulation from the second area j−1.

15. The method as recited in claim 14, wherein the step (a) further comprises, dividing the non-volatile memory into an extra third area, where the extra third area serves the purpose for a backup for the first area.

16. The method as recited in claim 15, further comprising steps of:

(h) judging if there exists errors in the complete data of the color/brightness accumulation or the high-bit data stored in the first area; and (i) if there does, obtaining the color/brightness accumulation or the high-bit data of the color/brightness accumulation from the third area.

17. The method as recited in claim 14, wherein the area(s) have a plurality of sectors.

18. The method as recited in claim 17, wherein each of the sectors has an error detecting code.

19. The method as recited in claim 18, wherein the error detecting code is a CRC code.

20. The method as recited in claim 14, wherein there is further included a carry virtual bit in the second areas.

21. The method as recited in claim 14, wherein the non-volatile memory is a flash memory.

* * * * *